US006662902B1

(12) United States Patent
McGuire

(10) Patent No.: US 6,662,902 B1
(45) Date of Patent: Dec. 16, 2003

(54) SAFETY LADDER SCAFFOLD

(76) Inventor: Barry K. McGuire, 83 Jordan St., Brockton, MA (US) 02302

( * ) Notice: Subject to any disclaimer, the term of this patent is extended or adjusted under 35 U.S.C. 154(b) by 0 days.

(21) Appl. No.: 10/118,055

(22) Filed: Apr. 9, 2002

(51) Int. Cl.[7] ..... E06C 7/16
(52) U.S. Cl. ..... 182/117; 182/113; 182/121
(58) Field of Search ..... 182/82, 107, 113, 182/117, 121, 122; 256/65; 248/228, 237, 238

(56) References Cited

U.S. PATENT DOCUMENTS

| | | | | | |
|---|---|---|---|---|---|
| 2,245,223 | A | * | 6/1941 | O'Meara | 182/117 |
| 2,706,662 | A | | 4/1955 | Brown | |
| 2,732,264 | A | * | 1/1956 | Smith et al. | 182/117 |
| 3,340,960 | A | * | 9/1967 | Wilson | 182/117 |
| 3,480,257 | A | | 11/1969 | Bourn et al. | |
| 3,491,852 | A | * | 1/1970 | Leist | 182/117 |
| 3,867,997 | A | | 2/1975 | Hyslop, Jr. | |
| 4,941,547 | A | | 7/1990 | Livick | |
| 5,060,754 | A | | 10/1991 | Feick | |
| 5,647,452 | A | * | 7/1997 | Gauthier | 182/117 |
| 5,862,881 | A | | 1/1999 | O'Brien | |
| 5,992,564 | A | * | 11/1999 | Kirkpatrick | 182/117 |
| 6,003,629 | A | | 12/1999 | Cloutier et al. | |
| 6,109,391 | A | | 8/2000 | Tyson | |
| 6,131,698 | A | * | 10/2000 | Reyland | 182/82 |
| 6,148,957 | A | | 11/2000 | Ahl et al. | |
| 6,286,624 | B1 | * | 9/2001 | Bowles | 182/117 |
| 6,511,275 | B2 | * | 1/2003 | Ray | 414/11 |

FOREIGN PATENT DOCUMENTS

| | | | | |
|---|---|---|---|---|
| EP | 315438 | * | 11/1988 | 182/117 |

* cited by examiner

*Primary Examiner*—Bruce A. Lev
(74) *Attorney, Agent, or Firm*—John P. McGonagle

(57) ABSTRACT

A worker back support which is laterally and slidably attached to a scaffold plank. The back support has a grip which is releasably attached about the waist of the worker. The back support provides the worker with backward support and a safe attachment to the scaffold. A high pressure hose used for washing or sand blasting a wall surface may be attached to and braced by the back support, thereby reducing the working pressure on a worker.

10 Claims, 9 Drawing Sheets

SAFETY LADDER SCAFFOLD

BACKGROUND OF THE INVENTION

This invention relates generally to ladder scaffolds, and in particular to a ladder scaffold with a safety mechanism for a worker on the scaffold.

Ladders are well known for use in building construction, painting and repair. For the repairs, maintenance or painting of exterior walls workmen usually stand on the rungs of a ladder propped against the wall. While convenient and easy to use, ladders limit the access of a workman to the work surface. If a ladder is leaning against a wall, a worker standing on the ladder has the ladder as a barrier between himself and the wall. He can reach the wall for only a short distance through or on either side of the ladder.

To overcome the limitation of working from ladders, scaffolds have been developed in the prior art which attach to a pair of ladders. Typically, a ladder scaffold is a flat plank attached to two ladders leaning against a wall. The plank is generally attached to an upper rung of each ladder by means of a ladder jack. See FIG. 1. The scaffold provides an easy way for a worker to substantially expand his coverage of a work surface.

The drawback with using a scaffold, however, is safety. With a ladder, the worker is actually laying against the rungs of a ladder and usually is holding on to one of the ladder rails or rungs with his nonworking hand. While on a scaffold, a worker has nothing to hold onto and relies completely on balance. One mistake or a slight backward misstep from the scaffold plank at a usual working level above the ground can be catastrophic for the worker. This is an especially serious problem for workers who are using high pressure hoses to wash down or sand blast a wall surface, the pressure from the hose tending to push the worker backward and making the worker's position on the scaffold quite unstable.

The prior art has made various modifications to ladder scaffolds to improve safety. These modifications, however, generally limit the worker's access to a work surface or limit his mobility on the scaffold.

SUMMARY OF THE INVENTION

The present invention's general purpose is to overcome the difficulties with prior art safety modifications to ladder scaffolds. The present invention provides a worker back support which is laterally and slidably attached to the scaffold. The back support has a belt which is releasably attached about the waist of the worker. The worker can thereby move laterally along the scaffold with his hands free and no obstructions between him and the wall work surface. The belted back support provides the worker with backward support and a safe attachment to the scaffold. In one embodiment of the invention, a high pressure hose used for washing or sand blasting a wall surface may be attached to and braced by the back support, thereby reducing the working pressure on a worker.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
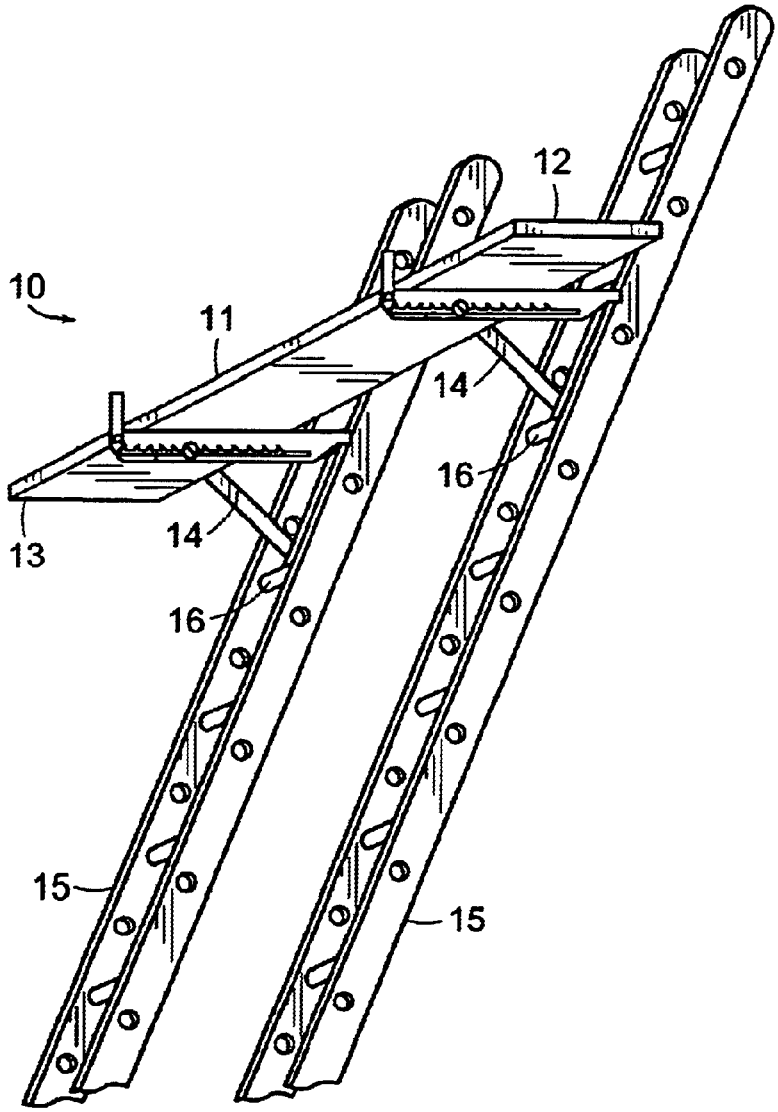
FIG. 1 is a perspective view of a prior art ladder scaffold attached to a pair of ladders by means of typical ladder jacks.
Figure 2:
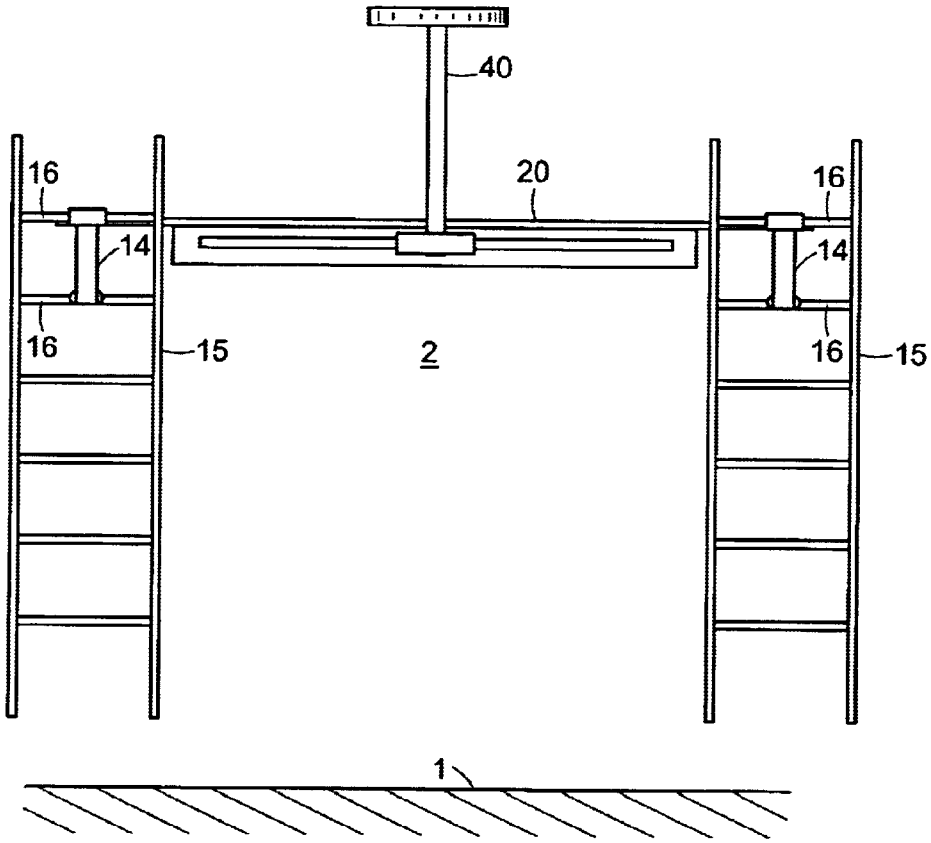
FIG. 2 is rear elevational view of the invention attached to two ladders by means of ladder jacks.
Figure 3:
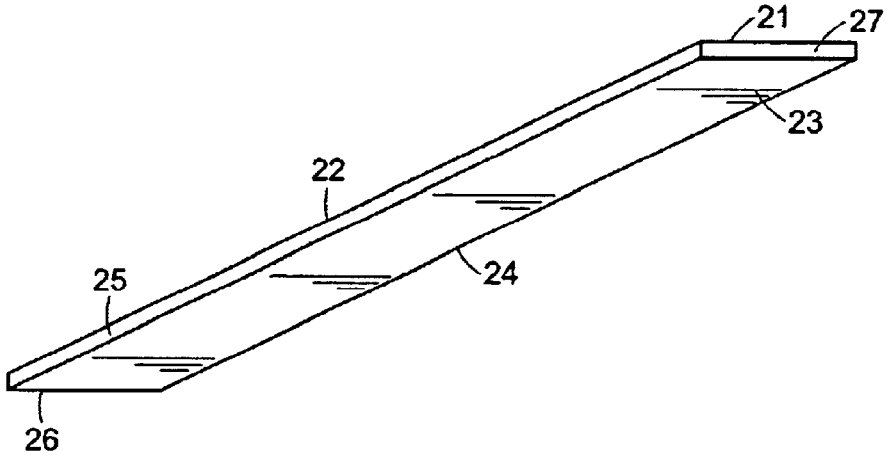
FIG. 3 is a bottom elevational view of a plank used in the present invention.
Figure 4:
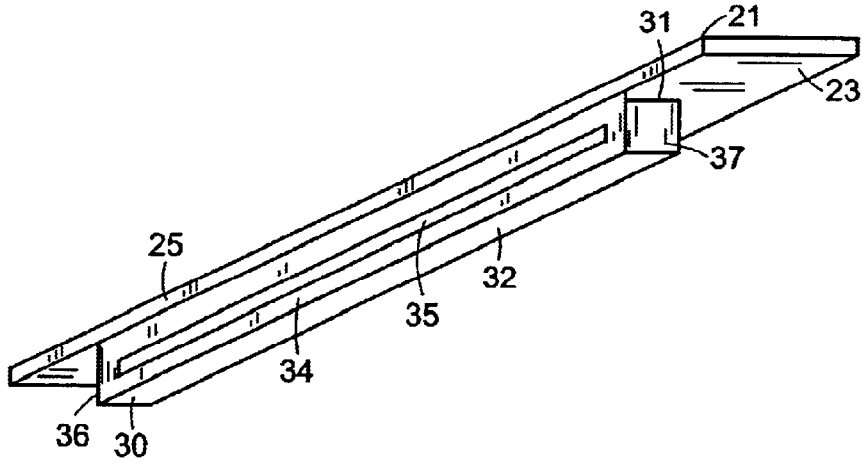
FIG. 4 is a bottom perspective view of a plank assembly used in the present invention.

Referring to the drawings in detail wherein like elements are indicated by like numerals, there is shown in FIG. 1 a prior art scaffold 10 attached to a pair of ladders 15 by means of typical ladder jacks 1. The scaffold 10 is comprised of scaffold platform comprised of a flat plank 11 having opposing first 12 and second 13 lateral end portions attached to individual ladder jacks 14 for supporting the platform in an elevated horizontal position intermediate two spaced apart ladders 15. The ladder jacks 14 are each removably attached to two adjacent rungs 16 of each ladder 15.

Referring to FIGS. 2–9 there is shown one embodiment of the present invention. The present invention is comprised of a plank assembly 20 with a back support 40 attached thereto, said plank assembly 20 being attached to individual ladder jacks 14 for supporting the plank assembly 20 in an elevated horizontal position intermediate two spaced apart ladders 15 leaning against a generally flat wall surface 2. The ladder jacks 14 are each removably attached to two adjacent rungs 16 of each ladder 15.

A basic ingredient of the plank assembly 20 is a standard rectangular plank 21. See FIG. 3. The plank 21 has an upper surface 22 and a lower surface 23, said surfaces laying in planes positioned horizontally with respect to the ground 1.

The plank 21 has a first long edge 24 and a second long edge 25, said first long edge 24 being nearest to the wall surface 2. The plank 21 also has a first lateral end 26 opposite a second lateral end 27, said lateral ends defining the longitudinal axis of the plank 21, said plank longitudinal axis lying horizontally parallel to said wall surface 2. An elongated, rectangular box 30 is fixedly attached to the plank lower surface 23, along and adjacent to the plank second long edge 25. See FIG. 4.

Figure 5:
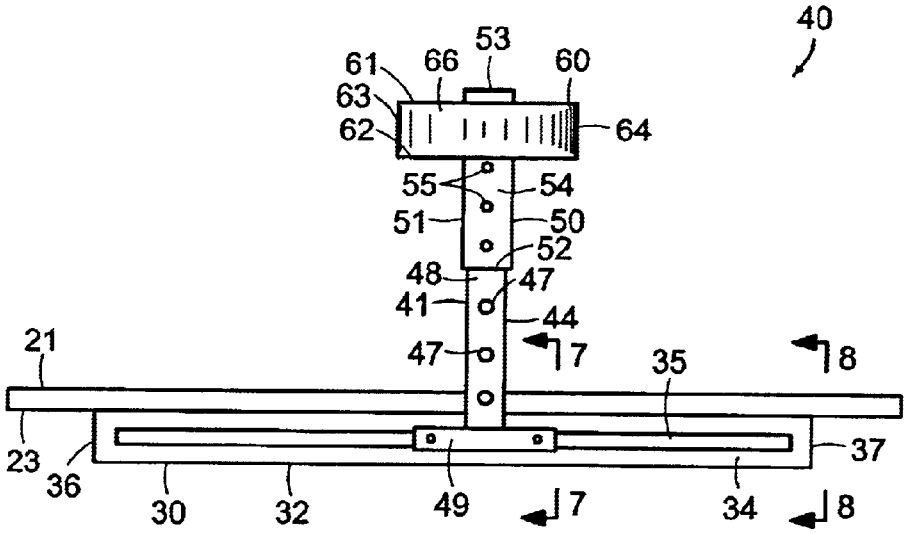
FIG. 5 is a close up view of the plank assembly of FIG. 2 with a back support.
Figure 6:
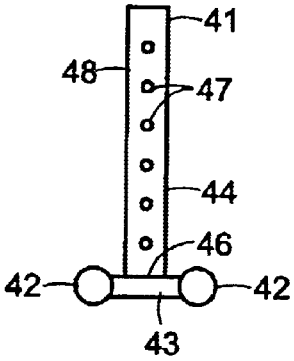
FIG. 6 is a view of the bottom portion of the back support of FIG. 5.
Figure 7:
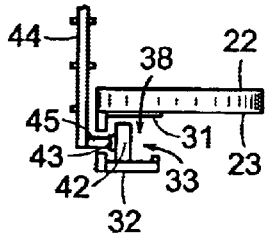
FIG. 7 is a view along the line 7—7 of FIG. 5.
Figure 8:
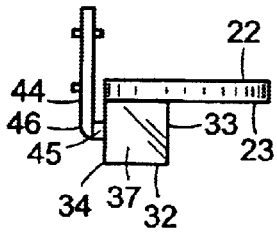
FIG. 8 is a view along the line 8—8 of FIG. 5.
Figure 9:
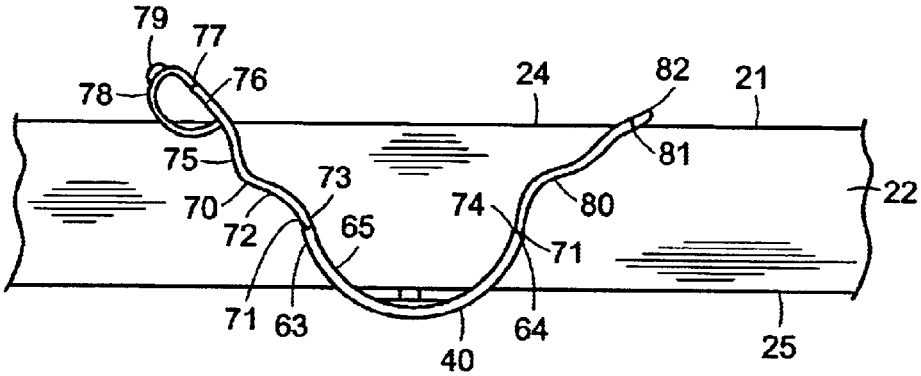
FIG. 9 is a top view of the back support of FIG. 2.

Referring more particularly to FIGS. 4, 5, 7 and 8, where FIG. 7 is a sectional view along the line 7—7 of FIG. 5 and FIG. 8 is a sectional view along the line 8—8 of FIG. 5, there is shown an elongated, rectangular box 30 having a top side 31 attached to the plank lower surface 23, an opposite bottom side 32, a first open side 33, an opposite second side 34, said second side 34 having an elongated, horizontal aperture 35 formed therein, a first end 36 and an opposite second end 37, said ends defining the longitudinal axis of the box 30, said box longitudinal axis being parallel to the plank longitudinal axis. The box sides 31, 32, 33, 34, and ends 36, 37 define a box interior 38. The length of the box 30 is less than the length of the plank 21. The box 30 is longitudinally centered along the plank 21 longitudinal axis.

Referring more particularly to FIGS. 5–8, the invention is further comprised of a back support 40. The back support 40 is comprised of a lower engagement portion 41 and an upper portion 50. The lower engagement portion 41 is comprised of a set of wheels 42 rotatably attached to an elongated, horizontal cross bar 43. The cross bar 43 has a horizontal, longitudinal axis parallel to the radial axis of the wheels 42. A vertical element 44 is attached to the cross bar 43 by means of a horizontal offset piece 45. The horizontal offset piece 45 has a horizontal, longitudinal axis perpendicular to the cross bar longitudinal axis. The cross bar 43 and wheels 42 are enclosed within the box interior 38. The offset piece 45 protrudes through the box second side aperture 35 and joins the vertical element bottom 46. The vertical element 44 contains a plurality of spring pin buttons 47 in a longitudinal row along its surface 48. In an alternate embodiment of the invention, a reinforcing cross bar 49, external to the box, may interconnect with the horizontal cross bar 43 to provide reinforcement and additional stability to the back support 40, said reinforcing cross bar 49 being a parallel, mirror image of the horizontal cross bar 43.

The back support upper portion 50 is comprised of an elongated sleeve element 51 having a bottom 52, an upper end 53, a surface 54 and a plurality of apertures 55 in a longitudinal row along its surface 54, said sleeve element 51 adapted to fit over said lower engagement portion vertical element 44, sleeve element bottom 52 first, said upper portion apertures 55 adapted to engage one or more lower engagement portion vertical element spring pin buttons 47.

A curved back rest 60 is attached to the upper portion sleeve element upper end 53. The back rest 60 has a top 61, a bottom 62, two lateral side ends 63, 64, a first surface side 65 and a second surface side 66, said first surface side 65 facing the wall surface 2. A horizontal strap assembly 70 is also provided, said strap assembly 70 adapted to laterally engage the waist of a worker. The horizontal strap assembly 70 is comprised of two attachment elements 71 affixed to the back rest lateral sides 63, 64, and an adjustable horizontal strap 72 with two ends 73, 74 each of which is removably attached to an attachment element 71. The horizontal strap 72 may be separated into two sections 75, 80. The first section 75 has a removable attachment end 73 and an opposite end 76 attached centrally to a conventional buckle 77, said buckle 77 fitted over the first strap section 75 forming an adjustable loop 78. Sliding the buckle 77 along the first strap section 75 makes the loop 78 smaller or larger thereby lengthening or shortening the effective length of the first strap section 75. The loop 78 is adapted to engage a fastener 79. The second strap section 80 has an attachment end 74 and an opposite end 81 terminating in a fastener 82, said fastener 82 adapted to engage said first section fastener 79. The fasteners 79, 82 may be hook and pile fasteners, sold under the Velcro trademark, or other conventional fastening means.

Figure 10:
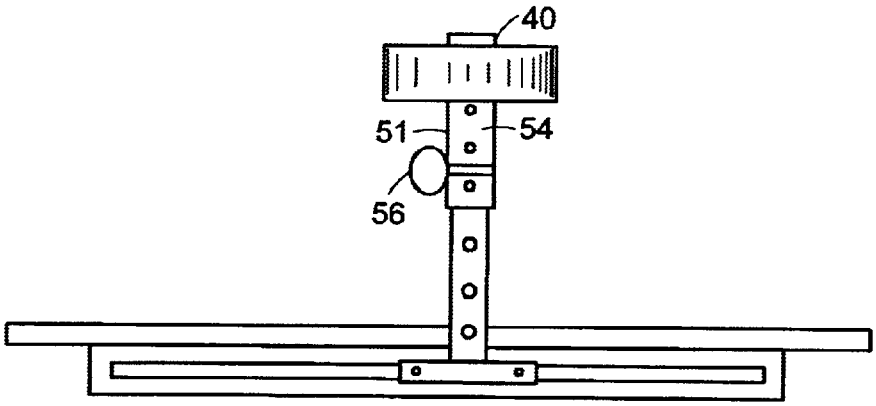
FIG. 10 is a close up view of the plank assembly of FIG. 2 with a back support modified with a clamping means.

Referring more particularly to FIG. 10, the upper portion sleeve element surface 54 may also have a supplemental strap or clamping means 56 attached thereto, said clamping means 56 adapted to engage hose assemblies such as those of a high pressure washer or sand blaster.

Figure 11A:
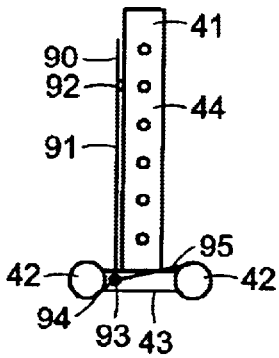
FIG. 11A is a view of the bottom portion of the back support modified with a braking means engaged.
Figure 11B:
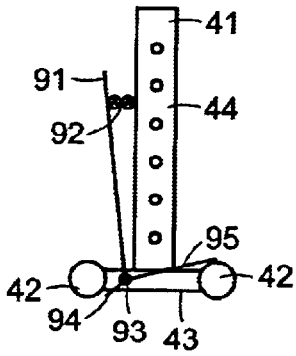
FIG. 11B is a view of the bottom portion of the back support modified with a braking means disengaged.
Figure 12:
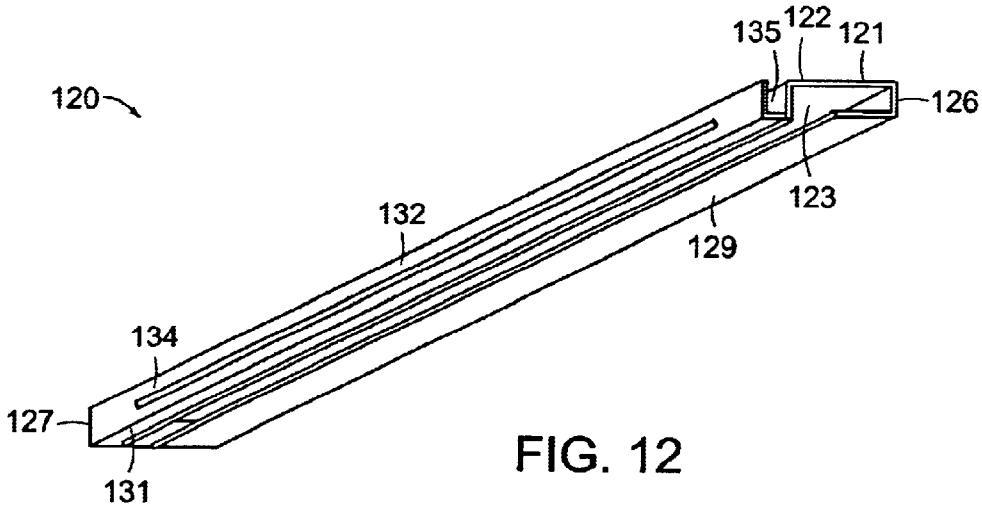
FIG. 12 is a bottom perspective view of a plank assembly used in another embodiment of the invention.
Figure 13:
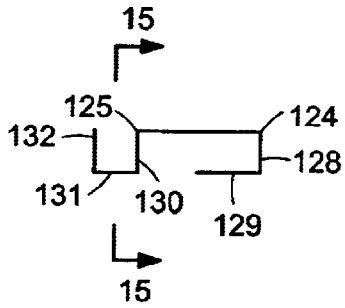
FIG. 13 is a cross-sectional view of the plank shown in FIG. 12.
Figure 14:
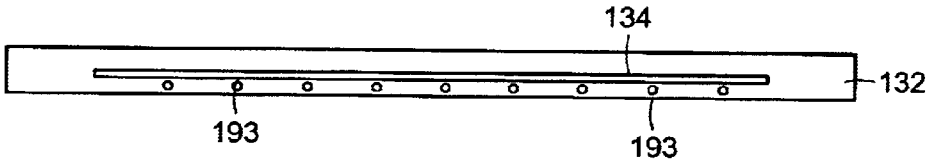
FIG. 14 is a front side view of the plank shown in FIG. 12.
Figure 15:
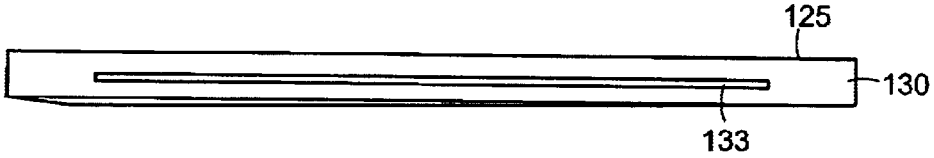
FIG. 15 is a view along the line 15—15 of FIG. 13.
Figure 16:
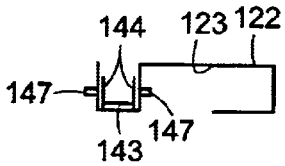
FIG. 16 is a cross-sectional view of the invention embodiment of FIG. 12 with lower engagement portion.
Figure 17:
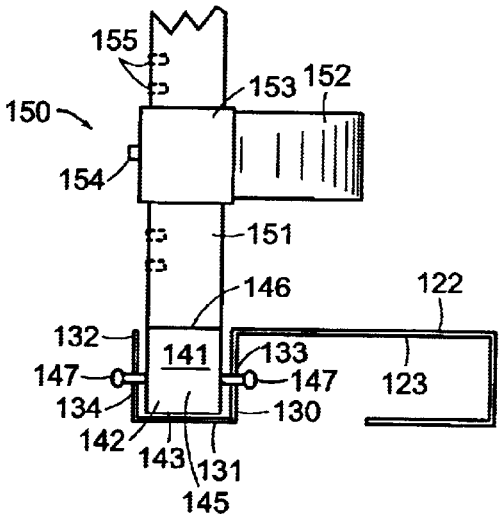
FIG. 17 is a cross-sectional view of the invention embodiment of FIG. 12 with the back support.

Referring more particularly to FIGS. 11A and 11B, the back support, lower engagement portion 41 may have a simple brake assembly 90 in order to lock the wheels 42 laterally in place along the box bottom 32. The brake assembly 90 is comprised of an elongated arm 91 pivotally connected by a pivot pin 93 to the horizontal cross bar 43. The arm 91 is connected to either the lower engagement portion vertical element 44 or upper portion sleeve element 51 by means of a tension spring 92 holding the arm against the vertical element 44 or sleeve element 51. When the arm 91 is at rest against the vertical element 44 or sleeve element 51, two braking elements 94, 95 pivotally attached to the arm 91 at the pivot pin 93 brakingly engage the wheels 42. When the arm 91 is pushed away from the vertical element 44 or sleeve element 51, the braking elements 94, 95 are disengaged from the wheels 42 and the wheels 42 are free to rotate.

Referring to FIGS. 12–19, there is shown another embodiment of the invention. This embodiment of the invention is comprised of a metallic plank assembly 120 with a back support 140 attached thereto, said plank assembly 120 being attached to individual ladder jacks 14 for supporting the plank assembly 120 in an elevated horizontal position intermediate two spaced apart ladders 15 leaning against a generally flat wall surface 2. The ladder jacks 14 are each removably attached to two adjacent rungs 16 of each ladder 15.

Because this embodiment of the invention is metallic, preferably aluminum for lightness, rectangular plank 21 of the first embodiment must be structurally strengthened to handle vertical loads. The resulting plank 121 has an upper surface 122 and a lower surface 123, said surfaces laying in planes positioned horizontally with respect to the ground 1. The plank 121 has a first long edge 124 and a second long edge 125, said first long edge 124 being nearest to the wall surface 2. The plank 121 also has a first lateral end 126 opposite a second lateral end 127, said lateral ends defining the longitudinal axis of the plank 121, said plank longitudinal axis lying horizontally parallel to said wall surface 2. The first long edge 124 has a downwardly extending first flange 128 terminates in an inward second flange 129 extending toward the second long edge 125 and having a plane parallel to the plank lower surface 123. The second flange 129 extends approximately half way beneath said plank 121. The second long edge 125 has a downwardly extending first flange 130 terminating in an outward second flange 131 extending away from the plank at an approximate 90° angle with the first flange 130, said second flange 131 having a plane parallel with the plane of the plank lower surface 123. The second flange 131 terminates in a third flange 132 extending upwardly away from the second flange at an approximate 90° angle, said third flange 132 having a plane parallel with the plane of the first flange 130. The three flanges 130, 131, 132 form a rectangular channel 135 with the first and third flanges 130, 132 forming vertical sides, the second flange 131 forming a horizontal bottom, and the channel 135 having an open top. The second long edge first flange 130 has an elongated, horizontal, central aperture 133 formed therein, said aperture 133 having a longitudinal axis parallel to the longitudinal axis of the plank 121. The second long edge third flange 132 also has an elongated, horizontal, central aperture 134 formed therein, said aperture 134 having a longitudinal axis parallel to the longitudinal axis of the plank 121, said apertures 133, 134 being parallel to each other. The flange arrangement extending from each long edge 124, 125 provides longitudinal, horizontal channel reinforcement of the plank thereby strengthening the metallic plank's ability to bear vertical loads.

Referring more particularly to FIGS. 16–19, the invention is further comprised of a back support 140. The back support 140 is comprised of a block-like lower engagement portion 141 and an upper portion 150. The lower engagement portion 141 is comprised of a rectangular box 142, having a top surface 146, bottom surface 143, two interconnecting, opposing parallel sides 144, and two opposing, parallel ends 145, said ends 145 defining the longitudinal axis of the said box 142, said box longitudinal axis being parallel to the longitudinal axis of the plank 121. The box 142 is adapted to fit into the channel 135, said box sides 144 being positioned adjacent the first and third flanges 130, 132, said box bottom surface 143 being adjacent the second flange 131. The lower engagement portion 141 is further comprised of two pins 135 extending through each of the box sides 144, said side pins 147 protruding from the sides 144 and engaging the second long edge first and third flange apertures 133, 134.

The back support upper portion 150 is comprised of a vertical post extending upwardly from the lower engagement portion box top surface 146. A curved waist grip 152 is attached to a sleeve 153 slidably affixed to said post 151, said sleeve 153 adapted to being locked into position by a locking pin 154 engaging one of a plurality of pin apertures 155 formed in said post 151.

Figure 18:
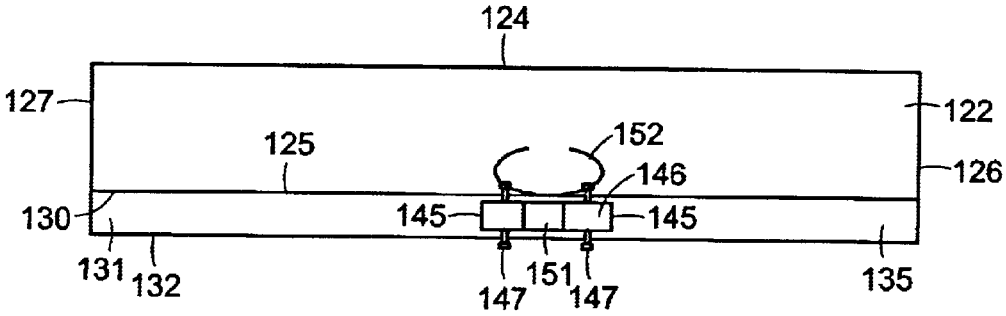
FIG. 18 is a top view of the second invention embodiment.
Figure 19:
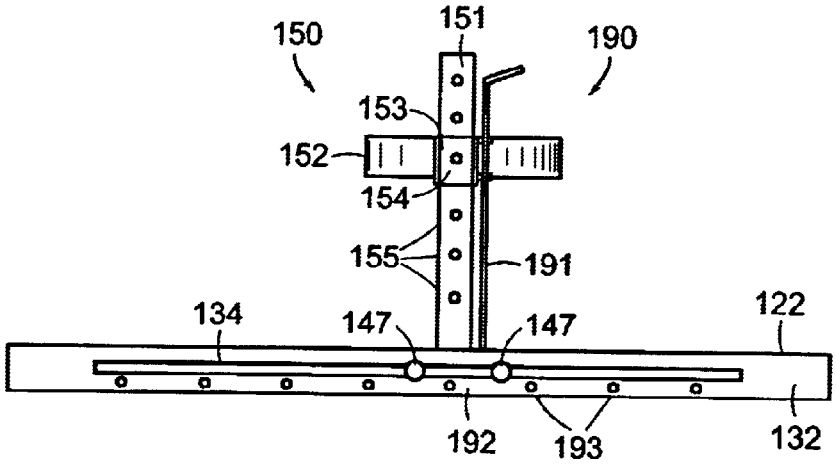
FIG. 19 is a side view of the second invention embodiment.

Referring more particularly to FIGS. 18 and 19, the upper portion 150 may have a simple brake assembly 190 comprised of an elongated arm 191 pivotally attached to the post 151. The elongated arm 191 has a bottom terminating in a 90° spike 192 adapted for engagement with one of a plurality of holes 193 formed in the second long edge third flange 132 beneath the elongated aperture 134.

It is understood that the above-described embodiment is merely illustrative of the application. Other embodiments may be readily devised by those skilled in the art which will embody the principles of the invention and fall within the spirit and scope thereof.

I claim:

1. A safety ladder scaffold in combination with and attached to a pair of ladders by a ladder jack installed on each ladder, said ladder jacks adapted for supporting the scaffold in an elevated horizontal position intermediate the two spaced apart ladders resting on the ground and leaning against a generally flat wall surface, comprising:

a plank assembly attached to said ladder jacks, said plank assembly being comprised of a metallic plank having an upper surface and a lower surface, said surfaces adapted to be lying in planes positioned horizontally and parallel with respect to the ground, said plank having a first long edge and a second long edge, said first long edge adapted to be nearest to the wall surface, said plank having a first lateral end opposite a second lateral end, said lateral ends defining a longitudinal axis of the plank, said plank longitudinal axis adapted to be lying horizontally parallel to said wall surface, said first long edge having a downwardly extending first flange terminating in an inward second flange extending toward the second long edge and having a plane parallel to the plank lower surface, said second flange extending approximately half way beneath said plank, said second long edge having a downwardly extending first flange terminating in an outward second flange extending away from the plank at an approximate 90° angle with the first flange, said second flange having a plane parallel with the plane of the plank lower surface, said second flange terminates in a third flange extending upwardly away from the second flange at an approximate 90° angle, said third flange having a plane parallel with the plane of the first flange, said three flanges forming a rectangular channel with the first and third flanges forming vertical sides, the second flange forming a horizontal bottom, and the channel having an open top, said second long edge first flange having an elongated, horizontal, central aperture formed therein, said aperture having a longitudinal axis parallel to the longitudinal axis of the plank, said second long edge third flange having an elongated, horizontal, central aperture formed therein, said aperture having a longitudinal axis parallel to the longitudinal axis of the plank, said apertures being parallel to each other;

a back support attached to said plank assembly, comprising:

a lower engagement portion comprising:

a rectangular box having a top surface, bottom surface, two interconnecting, opposing parallel sides, and two opposing, parallel ends, said ends defining a box longitudinal axis, said box longitudinal axis being parallel to the longitudinal axis of the plank, wherein the box is adapted to fit into the said plank assembly channel, said box sides being positioned adjacent the second long edge first and third flanges, said box bottom surface being adjacent the second long edge second flange; and a plurality of side pins extending through each of the box sides, said side pins protruding from the sides and engaging the second long edge first and third flange apertures;

an upper portion comprised of:

a vertical post extending upwardly from the lower engagement portion box top surface;

a sleeve slidably affixed to said post;

a curved waist grip attached to the sleeve.

2. A safety ladder scaffold as recited in claim 1, further comprising:

a plurality of pin apertures formed in said post;

a locking pin adapted to being inserted through said sleeve and engaging one of said pin apertures.

3. A safety ladder scaffold as recited in claim 2, further comprising:

a brake assembly comprised of an elongated arm pivotally attached to the post, said elongated arm having a bottom terminating in a spike adapted for engagement with one of a plurality of holes formed in the second long edge third flange beneath the elongated aperture.

4. A safety ladder scaffold as recited in claim 3, wherein:

said metallic plank is made from aluminum.

5. A safety ladder scaffold in combination with and attached to a pair of ladders by a ladder jack installed on each ladder, said ladder jacks adapted for supporting the scaffold in an elevated horizontal position intermediate the two spaced apart ladders resting on the ground and leaning against a generally flat wall surface, comprising:

a plank assembly attached to said ladder jacks, said plank assembly comprising:

a rectangular plank having an upper surface and a lower surface, said surfaces adapted to be lying in planes positioned horizontally and parallel with respect to the ground, said plank having a first long edge and a second long edge, said first long edge adapted to be nearest to the wall surface, said plank having a first lateral end opposite a second lateral end, said lateral ends defining a longitudinal axis of the plank, said plank longitudinal axis adapted to be lying horizontally parallel to said wall surface;

an elongated, rectangular box fixedly attached to the plank lower surface, along and adjacent to the plank second long edge, said rectangular box having a top side attached to the plank lower surface, an opposite bottom side, a first open side, an opposite second side, said second side having an elongated, horizontal aperture formed therein, a first end and an opposite second end, said ends defining a longitudinal axis of the box, said box longitudinal axis being parallel to the plank longitudinal axis, said box sides and ends defining a box interior, said box having a length less than a length of the plank , said box being longitudinally centered along the plank longitudinal axis;

a back support attached to said plank assembly, comprising:

a lower engagement portion having a set of wheels rotatably attached to an elongated, horizontal cross bar, said cross bar having a horizontal, longitudinal axis parallel to the radial axis of the wheels;

a vertical element attached to the cross bar by means of a horizontal offset piece, said horizontal offset piece having a horizontal, longitudinal axis perpendicular to the cross bar longitudinal axis, said cross bar and wheels being enclosed within the box interior, said offset piece protruding through the box second side aperture and joining the vertical element bottom, said vertical element containing a plurality of spring pin buttons in a longitudinal row along its surface; and an upper portion comprising an elongated sleeve element having a bottom, an upper end, a surface and a plurality of apertures in a longitudinal row along its surface, said sleeve element adapted to fit over said lower engagement portion vertical element, sleeve element bottom first, said upper portion apertures adapted to engage one or more lower engagement portion vertical element spring pin buttons;

a curved back rest attached to the upper portion sleeve element upper end, said back rest having a top, a bottom, two lateral side ends, a first surface side and a second surface side, said first surface side facing the wall surface.

6. A safety ladder scaffold as recited in claim 5, further comprising:

a horizontal strap assembly adapted to laterally engage the waist of a worker, said horizontal strap assembly being comprised of two attachment elements affixed to the back rest lateral sides, and an adjustable horizontal strap with two ends each of which is removably attached to an attachment element, said horizontal strap being separated into two sections, a first strap section having a removable attachment end and an opposite end attached centrally to a conventional buckle, said buckle fitted over the first strap section forming an adjustable loop, said loop being adapted to engage a fastener, a second strap section having an attachment end and an opposite end terminating in a fastener, said fastener adapted to engage said first section fastener.

7. A safety ladder scaffold as recited in claim 6, further comprising:

a clamping means attached to said upper portion sleeve element surface, said clamping means adapted to engage hose assemblies.

8. A safety ladder scaffold as recited in claim 7, further comprising:

a brake assembly adapted to lock the wheels laterally in place along the bottom of the box, comprising an elongated arm pivotally connected by a pivot pin to the horizontal cross bar, said arm being connected to the lower engagement portion vertical element by means of a tension spring holding the arm against the vertical element, said arm having two braking elements pivotally attached at the pivot pin, said braking elements adapted to brakingly engage the wheels.

9. A safety ladder scaffold as recited in claim 8, further comprising:

a reinforcing cross bar, external to the box, interconnecting with the horizontal cross bar to provide reinforcement and additional stability to the back support, said reinforcing cross bar being a parallel, mirror image of the horizontal cross bar.

10. A safety ladder scaffold as recited in claim 9, wherein: said clamping means is a strap.

* * * * *